US007891306B2

(12) United States Patent
Yamashita

(10) Patent No.: US 7,891,306 B2
(45) Date of Patent: Feb. 22, 2011

(54) STOOL

(75) Inventor: Mitsuo Yamashita, Hamamatsu (JP)

(73) Assignee: Kabushiki Kaisha Kawai Gakki Seisakusho, Shizuoka-Ken (JP)

( * ) Notice: Subject to any disclaimer, the term of this patent is extended or adjusted under 35 U.S.C. 154(b) by 0 days.

(21) Appl. No.: 11/845,818

(22) Filed: Aug. 28, 2007

(65) Prior Publication Data

US 2008/0277992 A1 Nov. 13, 2008

(30) Foreign Application Priority Data

May 8, 2007 (JP) ..... 2007-123604

(51) Int. Cl.
*A47B 57/00* (2006.01)

(52) U.S. Cl. ..... 108/93; 297/423.1; 297/423.39

(58) Field of Classification Search ..... 297/423.18, 297/449.1, 445.1, 423.39, 423.41, 175, 423.1; 108/101, 180, 186, 187, 155, 153.1, 153.11, 108/157.14, 165, 93; 312/235.1
See application file for complete search history.

(56) References Cited

U.S. PATENT DOCUMENTS

| | | | | | |
|---|---|---|---|---|---|
| 360,547 | A * | 4/1887 | Winslow | 108/110 |
| 619,071 | A * | 2/1899 | Criddle | 297/423.38 |
| 1,422,613 | A * | 7/1922 | Ogden | 108/11 |
| 1,465,291 | A * | 8/1923 | Walker | 297/150 |
| 2,643,045 | A * | 6/1953 | Renfro | 182/220 |
| 2,917,104 | A * | 12/1959 | Cottle | 248/157 |
| 3,259,079 | A * | 7/1966 | Freeman | 108/59 |
| 3,695,684 | A * | 10/1972 | Barberg | 297/1 |
| 3,862,691 | A * | 1/1975 | Mori et al. | 211/191 |
| 4,109,961 | A * | 8/1978 | Opsvik | 297/338 |
| 4,258,827 | A * | 3/1981 | Klose | 182/33.3 |
| 4,348,053 | A * | 9/1982 | Strassle | 297/445.1 |
| 4,379,431 | A * | 4/1983 | Clement | 108/186 |
| 4,500,146 | A * | 2/1985 | Peterson | 312/257.1 |
| 4,944,556 | A * | 7/1990 | Griesbaum et al. | 297/423.38 |
| 5,312,161 | A * | 5/1994 | Mars | 297/423.2 |
| D362,554 | S * | 9/1995 | Grundner | D6/339 |
| 5,813,737 | A * | 9/1998 | Stone | 312/257.1 |
| 5,836,652 | A * | 11/1998 | Wexler et al. | 297/423.28 |
| 5,865,129 | A * | 2/1999 | Samples | 108/157.17 |
| 6,017,092 | A * | 1/2000 | Lee | 297/440.15 |
| 6,217,120 | B1 * | 4/2001 | Pugliese | 297/440.1 |
| D460,871 | S * | 7/2002 | Opsvik | D6/367 |
| D460,875 | S * | 7/2002 | Schweikarth et al. | D6/379 |
| 6,840,583 | B1 * | 1/2005 | Turner et al. | 297/423.19 |
| 6,877,826 | B2 * | 4/2005 | Wood et al. | 312/205 |
| 7,124,695 | B2 * | 10/2006 | Buechler | 108/180 |
| 7,322,656 | B2 * | 1/2008 | Wang | 297/423.41 |
| 7,484,465 | B2 * | 2/2009 | Laby | 108/180 |

FOREIGN PATENT DOCUMENTS

| | | |
|---|---|---|
| JP | 4-10756 | 1/1992 |
| JP | 5-94890 | 12/1993 |

* cited by examiner

*Primary Examiner*—David Dunn
*Assistant Examiner*—Erika Garrett
(74) *Attorney, Agent, or Firm*—Davis & Bujold, P.L.L.C.

(57) ABSTRACT

A stool includes a seat board, a plurality of legs, and a connecting board. The plurality of legs is attached to the seat board so as to protrude from the seat board in a downward direction, and to support the seat board such that the seat board is horizontally held. The connecting board is disposed such that one surface thereof faces a bottom surface of the seat board. The connecting board is surrounded by and secured to the plurality of legs.

14 Claims, 8 Drawing Sheets

STOOL

CROSS-REFERENCE TO RELATED APPLICATIONS

This application claims the benefit of Japanese Patent Application No. 2007-123604 filed May 8, 2007 in the Japanese Patent Office, the disclosure of which is incorporated herein by reference.

BACKGROUND

This invention relates to a stool for a keyboard musical instrument, such as a piano, an electronic organ, and the like.

A conventional stool used for a keyboard musical instrument, such as a piano, an electronic organ, and the like, is generally configured such that four corners of a rectangular seat board are supported by four legs protruding downward.

As an example of a stool configured as above, Unexamined Japanese Utility Model Publication No. 04-10756 discloses a stool having a seat board and an auxiliary seat board disposed beneath the seat board. The stool is also provided with reinforcement boards between one pair of legs disposed on the left side of the stool, and between one pair of legs disposed on the right side of the stool. An elongate hole is formed on each of the reinforcement boards, wherein an engagement rod of the auxiliary seat board is engaged therewith. The auxiliary seat board is slid along the elongate holes. It is to be noted that the Publication No. 04-10756 does not specifically mention the disclosed stool is used for a keyboard musical instrument.

As another example of a stool configured as above, Unexamined Japanese Utility Model Publication No. 05-94890 discloses a stool used for a keyboard musical instrument. The stool is provided with a foot rest rotatably attached between one pair of legs disposed in a side of a player's legs. More specifically, the foot rest is unfolded toward a player's legs, when front links and rear links of stays provided to the foot rest are linearly aligned. The foot rest is stored between the pair of legs, when the front links and the rear links are folded. The foot rest of the stool is unfolded if a player is a child so that the player can place his/her foot thereon. On the other hand, the foot rest is stored if a player is an adult so that legs of the player do not touch the foot rest.

Stools, wherein a seat board is supported by four legs protruding downward, such as the stools described above, have a high strength against a downward load, since a load applied downward onto the seat board when a player sits thereon is supported by the four legs.

SUMMARY

However, in the stool disclosed in the Publication No. 04-10756, the auxiliary seat board is slidably attached and, therefore, is not meant for reliably supporting the legs. As a result, preventing the legs from being tilted is difficult in this stool when a large load is applied to the seat board in a lateral direction.

With regard to the stool disclosed in the Publication No. 05-94890, although the foot rest is attached to the supporting legs via stays, the foot rest is configured to rotate with respect to the supporting legs when the stays are folded. Therefore, the foot rest is not configured so as to reliably support the legs. As a result, preventing the legs from being tilted is difficult in this stool when a large load is applied to the seat board in a lateral direction.

The present invention preferably provides a stool wherein deformation can be inhibited against a load applied in a direction intersecting a downward direction of the stool.

In one aspect of the present invention, a stool includes a seat board, a plurality of legs, and a connecting board. The plurality of legs is attached to the seat board so as to protrude from the seat board in a downward direction, and to support the seat board such that the seat board is horizontally held. The connecting board is disposed such that one surface thereof faces a bottom surface of the seat board. The connecting board is surrounded by and secured to the plurality of legs.

In the stool configured as above, the connecting board supports the plurality of legs against a load applied in a direction intersecting a downward direction. Therefore, deformation of the stool as a result of a load applied in a direction intersecting the downward direction can be inhibited.

The connecting board may be secured to the plurality of legs so as to be horizontally held.

In this case, deformation of the stool can be inhibited against a load applied in all directions intersecting the downward direction.

The plurality of legs may be respectively attached in vicinity of a periphery of the seat board.

In this cases the strength of the stool can be increased against a load applied in a direction intersecting the downward direction, as compared to a case wherein the plurality of legs is attached to an inner side of the seat board.

The connecting board may be secured to a lower portion of each of the plurality of legs.

In this case, the strength of the stool can be increased against a load applied to a direction intersecting the downward direction, as compared to a case wherein the connecting board is secured to an upper portion of each of the plurality of legs.

The stool according to the present invention may further include an adjustment mechanism that enables to change a securing position of the connecting board with respect to each of the plurality of legs in an up-and-down direction.

In this case, a user of the stool may freely change the securing position of the connecting board depending, for example, on a state of use of the stool.

The adjustment mechanism may be configured in any manner, as long as the adjustment mechanism enables to change the securing position of the connecting board in the up-and-down direction.

For example, the adjustment mechanism may be configured so as to removably secure the connecting board in one of a plurality of predetermined positions provided on each of the plurality of legs along the up-and-down direction.

With the adjustment mechanism configured as above, a user of the stool can easily change the securing position of the connecting board simply by removing the connecting board from one of the predetermined positions and securing the connecting board in another predetermined position.

Such adjustment mechanism may include, for example, a plurality of engaged members, each of which is provided in one of the plurality of predetermined positions. The adjustment mechanism may also include an engagement mechanism that removably engages the connecting board with the plurality of engaged members.

In this case, the securing position of the connecting board can be easily changed simply by engaging/disengaging the connecting board with/from the plurality of engaged members.

The engagement mechanism may include a plurality of engaging members, each of which is associated with one of the plurality of legs. Each of the plurality of engaging members may include a connecting portion to be connected to the connecting board, and an engagement portion to be engaged with one of the engaged members.

Each of the plurality of engaged members may be, for example, a nut. For such engaged members, the engagement mechanism may be constituted with a plurality of bolts. Each of the plurality of bolts is associated with one of the plurality of engaging members. The engagement mechanism may be configured such that each of the plurality of bolts is inserted into the engagement portion of one of the plurality of engaging members so as to be engaged with one of the plurality of engaged members.

The plurality of engaged members may be embedded in the plurality of legs.

In this case, the securing position of the connecting board can be easily changed without the plurality of engaged members contacting the connecting board.

The plurality of engaging members may be configured such that the connecting portion is connected to a bottom surface of the connecting board, and the engagement portion is engaged with one of the plurality of engaged members.

In this case, the connecting board is supported from a bottom surface side thereof. Therefore, the upper surface of the connecting board can be used for some other purposes.

The bottom surface of the connecting board may be provided with a plurality of engagement openings so as to engage a plurality of screw members with the bottom surface of the connecting board. Each of the plurality of engagement openings may be associated with one of the plurality of engaging members. Each of the plurality of engaging members may be provided with a through hole formed in the connecting portion so as to insert one of the plurality of screw members into one of the plurality of engagement openings. An opening of the through hole may extend, in a direction such that a position for inserting one of the plurality of screw members is displaced corresponding to a change in the securing position of the connecting board.

In this case, an additional through hole does not need to be provided to each of the engaging members, even if the position for inserting one of the plurality of screw members is displaced due to a manufacturing error in the connection board or the plurality of legs.

Moreover, an additional through hole does not need to be provided to each of the engaging members, even in a case wherein the thickness or the shape of the plurality of legs differs from an upper portion and a lower portion thereof, and the securing position of each of the plurality of engaging members with respect to the connecting board needs to be changed depending on the securing position of the connecting board.

Each of the plurality of engaging members may be a plate member formed into a L-shape.

The connecting board may include at least one concave disposed in a periphery of the connecting board, and concaved toward an inner direction of the connecting board.

In this case, legs of a user of the stool can be inhibited from contacting the connecting board.

The connecting board may include an inclined portion projecting outward from a periphery of the connecting board, and inclined downward.

In this case, a user can stabilize his/her posture by contacting his/her foot with the inclined portion.

One part of the connecting board may be constituted with a single member. The single member may be configured so as to be secured to the plurality of legs and support the inclined portion such that the inclined portion is movable in an inner and the outer direction of the connecting board.

In this case, whenever a user of the stool needs the inclined portion, the user can use the inclined portion by moving the inclined portion in the outer direction of the connecting board.

In addition, when the inclined portion is not used or when a user of the stool does not need to use the inclined portion, the inclined portion can be stored inside of the connecting board.

BRIEF DESCRIPTION OF THE DRAWINGS

The invention will now be described below, by way of example, with reference to the accompanying drawings, in which:

FIGS. 2A and 2B are explanatory views showing a securing position adjustment mechanism according to the first embodiment, wherein FIG. 2A shows an engaging member, a bolt, an embedded nut, and a wooden screw, and wherein FIG. 2B shows the engaging member in a detailed manner;

DETAILED DESCRIPTION OF THE PREFERRED EMBODIMENT

First Embodiment

Figure 1A:
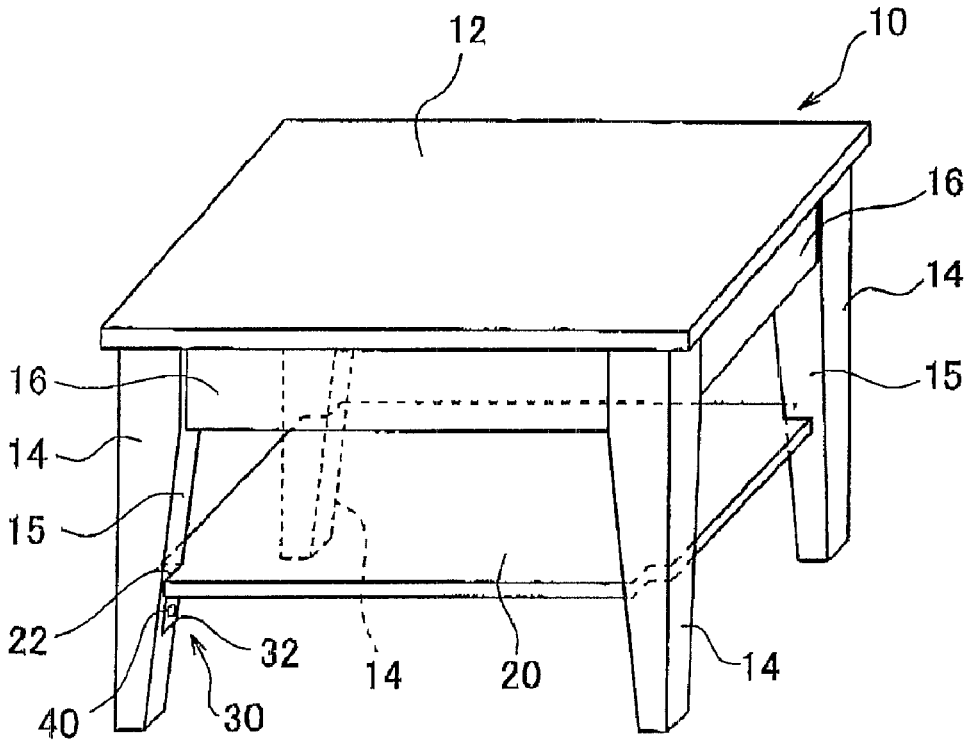
FIG. 1A is a perspective view showing a stool according to a first embodiment of the present invention.
Figure 1B:
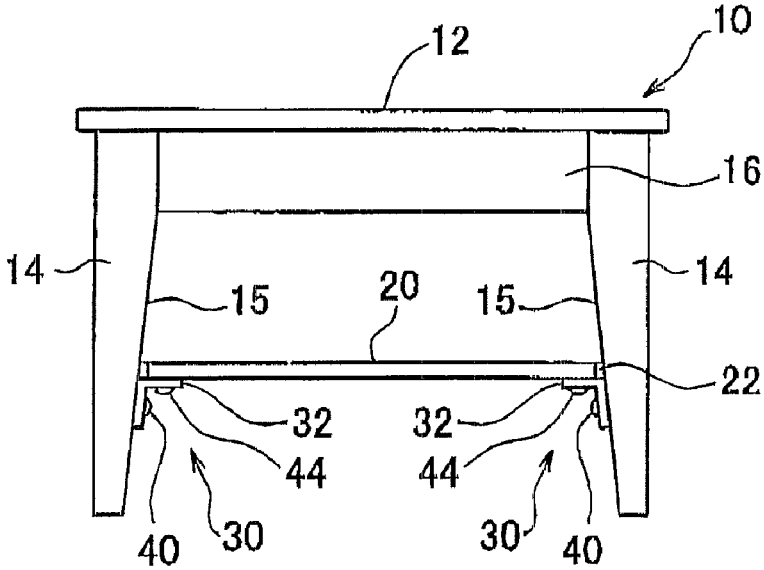
FIG. 1B is a front view showing the stool according to the first embodiment.

A stool 10 shown in FIGS. 1A and 1B is a wooden stool used by a player of a keyboard musical instrument, such as a piano, an organ and so on.

The stool 10 includes a seat board 12, four legs 14, four cross boards 16, a connecting board 20, and a securing position adjustment mechanism 30.

The seat board 12 is made of a board material having a flat rectangular shape.

The four legs 14 are made of wooden rectangular timbers, and attached to the seat board 12 so as to project downward from the seat board 12. The four legs 14 support the seat board 12 such that the seat board 12 is horizontally held. More specifically, the four legs 14 have lengths equivalent to, one another. Each of the legs 14 is attached to one of four corner portions on a bottom surface of the seat board 12 so as to project downward from the seat board 12 approximately in a vertical manner. Two lateral surfaces of each of the legs 14, facing the inner side of the stool 10, are provided with tapered surfaces 15 such that the legs 14 are tapered toward the bottom side.

The four cross boards 16 are made of board materials. Each of the cross boards 16 is standingly disposed on the bottom surface of the seat board 12, and connects the upper portions of the legs 14 disposed adjacent to each other in the circumferential direction of the stool 10.

The connecting board 20 is made of a single board material having a rectangular flat surface. The connecting board 20 is secured to the four legs 14 such that the top surface of the connecting board 20 faces the bottom surface of the seat board 12 and the connecting board 12 is surrounded by the four legs 14. More specifically, the connecting board 12 is secured to the lower portions of the four legs 14 so as to be horizontally held. Four corner portions of the connecting board 20 are provided with notches 22 such that the connecting board 20 is engaged with the taper surfaces 15 of the respective legs 14. Each of the notches 22 is formed so as to have an orthogonal angle so that each of the legs 14 fits therein.

The securing position adjustment mechanism 30 includes four engaging members 32, four bolts 40, at least 12 embedded nuts 42 (see FIG. 2A), and four wooden screws 44.

Each of the four engaging members 82 is associated with one of the legs 14. Each of the four bolts 40 is associated with one of the engaging members 32. As well as the four bolts 40, each of the four wooden screws 44 is associated with one of the engaging members 32.

Figure 2A:
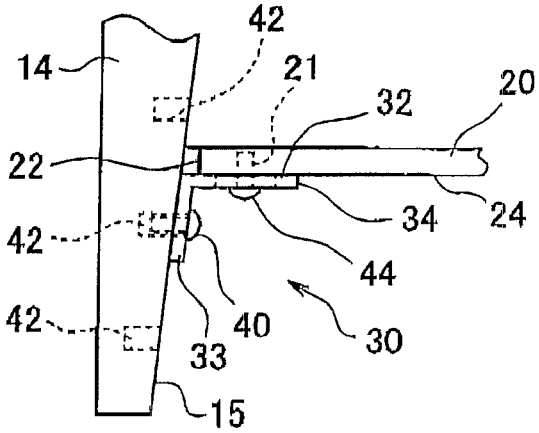

As shown in FIG. 2A, in at least one of the two taper surfaces 15 provided to each of the legs 14, three embedded nuts 42 are inserted in an up-and-down direction.

Each of the engaging members 32 is made of a metallic plate member, and provided with an engagement portion 33 and a connection portion 34. Each of the engaging members 32 is formed such that the connection portion 34 contacts with the bottom surface of the connection board 20 and the engagement portion 33 contacts with the taper surface 15 of one of the legs 14.

More specifically, each of the engaging members 32 is formed approximately in a L-shape which is opened at a predetermined angle larger than an orthogonal angle so that the engagement portion 33 and the connection portion 34 fit the inclination of the taper surface 15.

Figure 2B:
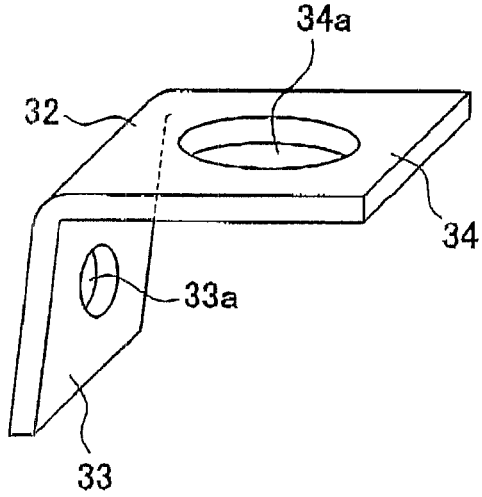

As shown in FIG. 2B, the engagement portion 33 is provided with a circular hole 33*a* through which one of the bolts 40 is inserted. The connection portion 34 is provided with an elongate hole 34*a* through which one of the wooden screws 44 is inserted.

Into the circular hole 33*a* of the engagement portion 33, one of the bolts 40 is inserted so as to be connected to the one of the embedded nuts 42. On the other hand, into the elongate hole 34*a* of the connection portion 34, one of the wooden screws 44 is inserted so as to be connected to one of four connection openings 21 formed on the bottom surface of the connecting board 20. Each of the four connection openings 21 is associated with one of the engaging members 32.

Due to each of the engaging members 32 being connected to one of the legs 14 and the connecting board 20 as described above, the connecting board 20 connects and supports the four legs 14.

In this configuration, the securing position, wherein the connection board 20 is secured to each of the legs 14, can be adjusted in the up-and-down direction by connecting the bolt 40 with one of the three embedded nuts 42 provided in the up-and-down direction to each of the legs 14. When the securing position of the connecting board 20 is changed, the clearance of each of the notches 22 of the connecting board 20 and the taper surface 15 of each of the legs 14 changes. As a result, the position for inserting the wooden screw 44 is changed.

Therefore, in the first embodiment of the present invention, the opening of the elongate hole 34*a* is formed so as to extend in the direction in which the position of insertion of the wooden screw 44 is displaced.

As described above, since the connecting board 20 of the stool 10 supports the four legs 14 against a load applied in a direction intersecting the downward direction, deformation of the stool 10 due to such load can be inhibited. Therefore, the stool 10 is less likely to be significantly deformed in the lateral direction even when a load is applied on the seat board 12 in the lateral direction by a player sitting thereon and moving his/her weight in the lateral direction.

Moreover, since the four engaging members 32 of the stool 10 are connected to the bottom surface of the connecting board 20 and support the connecting board 20 in the bottom surface side of the connecting board 20, the top surface of the connecting board 20 may be used for other purposes. For example, a player may place a hand luggage on the connecting board 20.

Furthermore, since the connecting board 20 of the stool 10 is secured to the legs 14 so as to be horizontally held, the stool 10 is inhibited from being deformed by a load applied in all directions intersecting the downward direction.

Still furthermore, the legs 14 of the stool 10 are attached to the four corner portions of the seat board 12, that is, in vicinity of the peripheral of the seat board 12. Therefore, the strength of the stool 10 is high against a load applied in a direction intersecting the downward direction, as compared to a case wherein the legs 14 are attached in the inner side of the seat board 12.

Moreover, since the connecting board 20 of the stool 10 is attached to the lower portions of the legs 14, the strength of the stool 10 is high against a load applied in a direction intersecting the downward direction, as compared to a case wherein the connecting board 20 is attached to the upper portions of the legs 14.

Moreover, the securing position of the connecting board 20 of the stool 10 can be changed in the up-and-down direction by the securing position adjustment mechanism 30. Therefore, a player may freely adjust the securing position of the connecting board 20 depending on the state of use of the stool 10.

Furthermore, the securing position of the connecting board 20 of the stool 10 can be easily changed simply by securing the connecting board 20 with bolts 40 inserting into embedded nuts 42, and removing the bolts 40 from the embedded nuts 42. A player may increase the strength of the stool 10 against a load applied in a direction intersecting the downward direction by changing the securing position of the connecting board 20 toward the lower portions of the legs 14.

Still furthermore, the embedded nuts 42 are used in the stool 10 so as to engage the connecting board 20 with each of the legs 14. As a result, the securing position of the connecting board 20 can be easily changed without the members for engaging the connecting board 20 contacting the connecting board 20.

Additionally, since the opening of the elongate hole 34*a* of the stool 10 is formed as described above, even when the securing position of the connecting board 20 is changed and the inserting position of the wooden screw 44 in the opening is displaced, the wooden screw 44 can be connected to the connecting opening 21, formed on the bottom surface of the connecting board 20, without providing the connection portion 34 with an additional hole. Moreover, even in a case wherein the clearance of the leg 14 and the notch 22 is changed due to a manufacturing error in the leg 14 or the connecting board 20, the wooden screw 44 can be connected to the connection opening 21 formed on the bottom surface of the connecting board 20 without providing the connection portion 34 with an additional hole. In other words, the degree of freedom is high concerning the attachment position of the connecting board 20 with respect to the engaging member 32.

Second Embodiment

A stool 50 according to the second embodiment is configured identically to the stool 10 according to the first embodiment, except for a connecting board thereof. The same referential numerals as in the first embodiment are given to the identical constituents, and the description thereof is omitted here. The following only describes the connecting board of the stool 50.

Figure 3A:
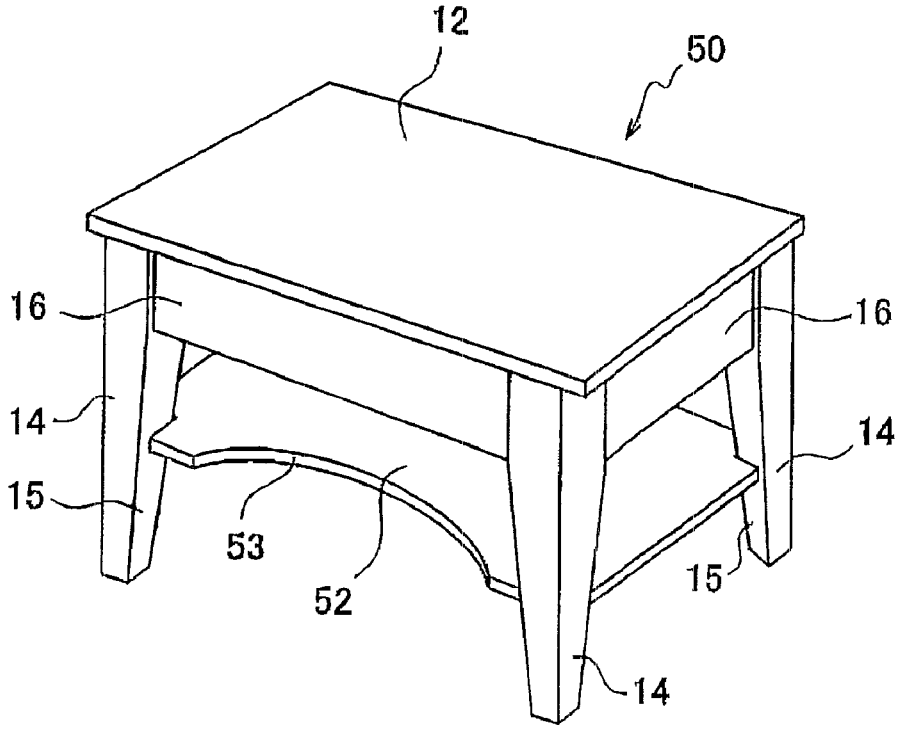
FIG. 3A is a perspective view showing a stool according to a second embodiment of the present invention.
Figure 3B:
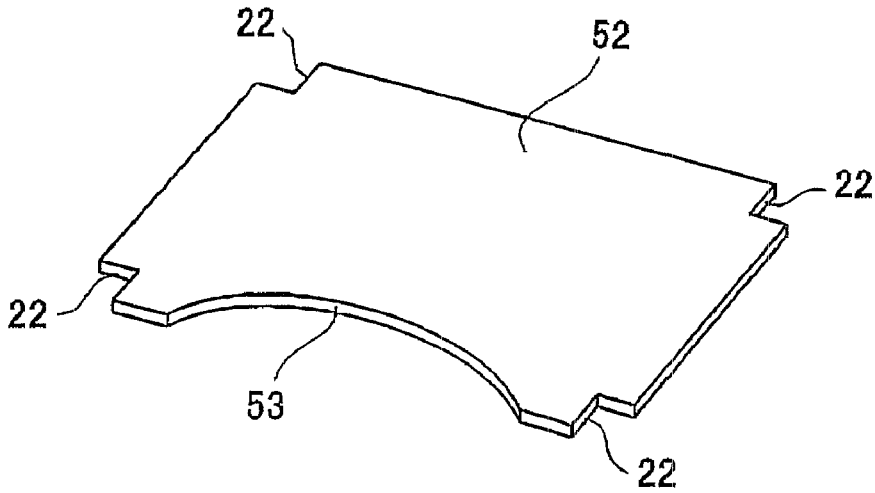
FIG. 3B is a perspective view showing a connecting board according to the second embodiment.

As shown in FIGS. 3A and 3B, the stool 50 is provided with a rectangular connecting board 52 having a cutout 53 in a shape of a circular arc concaved toward the inner direction of the connecting board 52. The cutout 53 is disposed in one of the four sides of the rectangular connecting board 52 where legs of a player are to be positioned.

In this configuration, as the securing position of the connecting board 52 comes to the lower portion of the leg 14, the strength of the stool 50 becomes increased against a load applied to a direction intersecting the downward direction. However, in a case wherein a connecting board is linearly configured in the side of player's legs as in the connecting board 20 according to the first embodiment, when the securing position of the connecting board is brought lower, legs of a player and the connecting board contact with each other and the connecting board is likely to interrupt the player's performance.

In the stool 50 according to the second embodiment, even when legs of a player approach the connecting board 52, the legs can enter within the cutout 53 of the connecting board 52. Therefore, legs of a player can be inhibited from contacting the connecting board 52. As a result, the connecting board 52 can be inhibited from interrupting performance of a player, while the strength of the stool 50 is increased against a load applied in a direction intersecting the downward direction.

Third Embodiment

Figure 4:
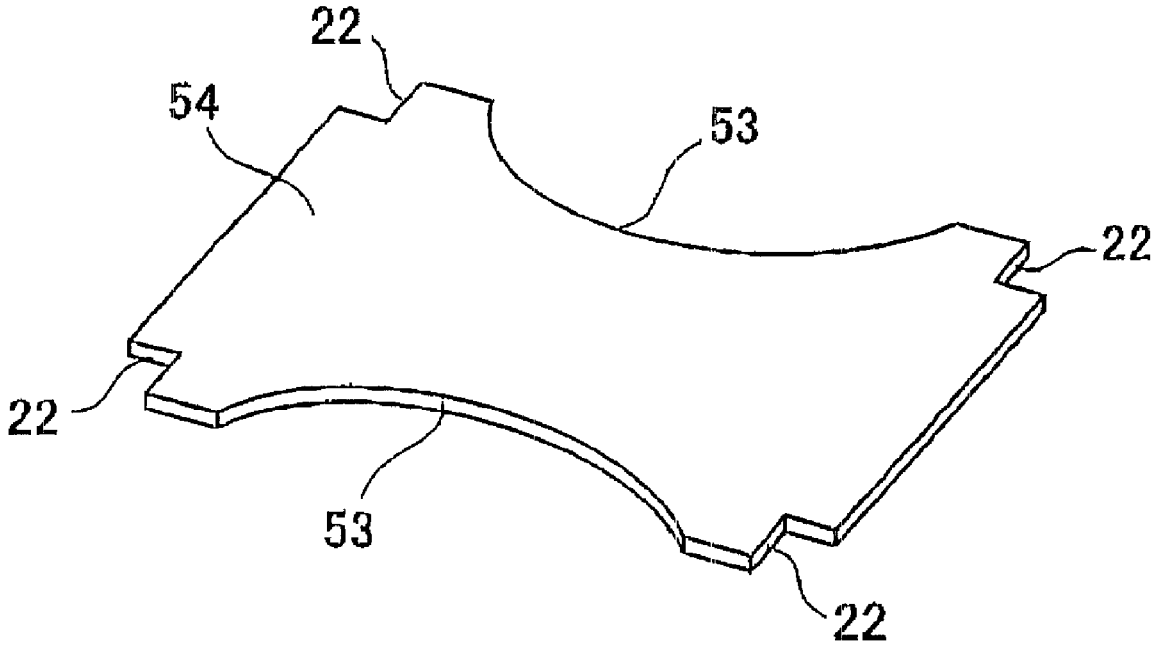
FIG. 4 is a perspective view showing a connecting board according to a third embodiment of the present invention.

As shown in FIG. 4, a connecting board 54 according to the third embodiment is provided with the above-described cutout 53 not only in the side of a player's legs, but also in the opposite side of the player's legs.

In addition to the cutout 53 disposed in the side of a player's legs, the connecting board 54 according to the third embodiment is provided with another cutout 53 in the opposite side. In this configuration, even when a player is seated on the stool toward a direction opposite to the above-described direction, legs of the player can still enter within the cutout 53 of the connecting board 54. Therefore, legs of a player can be inhibited from contacting the connecting board 54. As a result, while the strength of the stool 50 is increased against a load applied in a direction intersecting the downward direction, the connecting board 54 can be inhibited from interrupting performance of a player. Moreover, the degree of freedom given to a player in regard to a seating direction can be increased.

Fourth Embodiment

A stool 60 according to the fourth embodiment is configured identically to the stool 10 according to the first embodiment, except for a connecting board thereof. The same referential numerals as in the first embodiment are given to the identical constituents, and the description thereof is omitted here. The following only describes the connecting board of the stool 60.

Figure 5A:
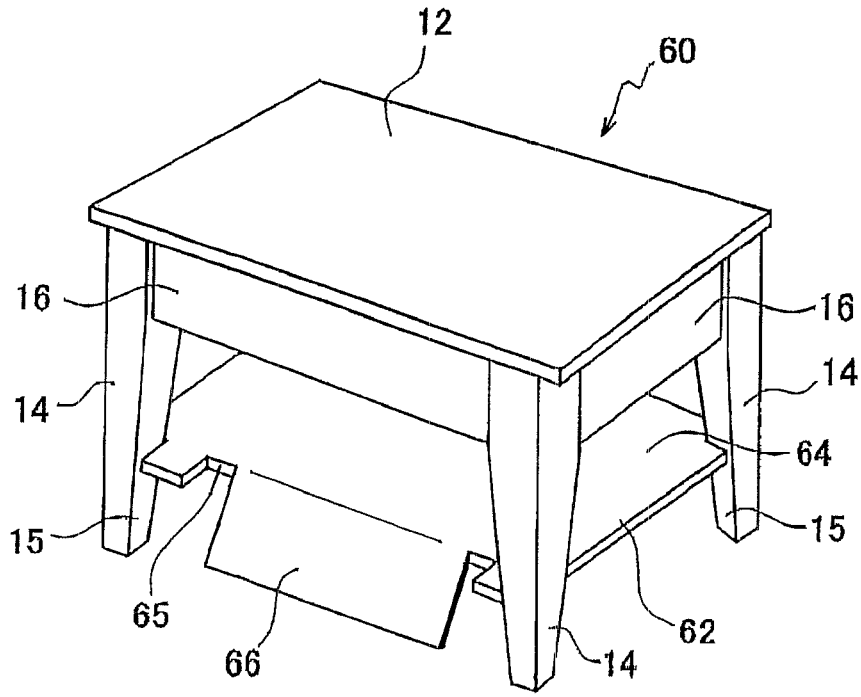
FIG. 5A is a perspective view showing a stool according to a fourth embodiment of the present invention.
Figure 5B:
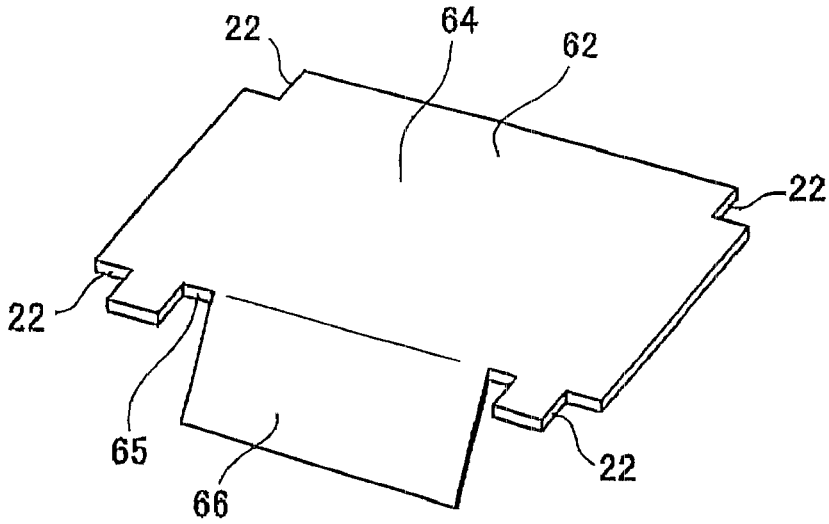
FIG. 5B is a perspective view showing a connecting board according to the fourth embodiment.
Figure 6:
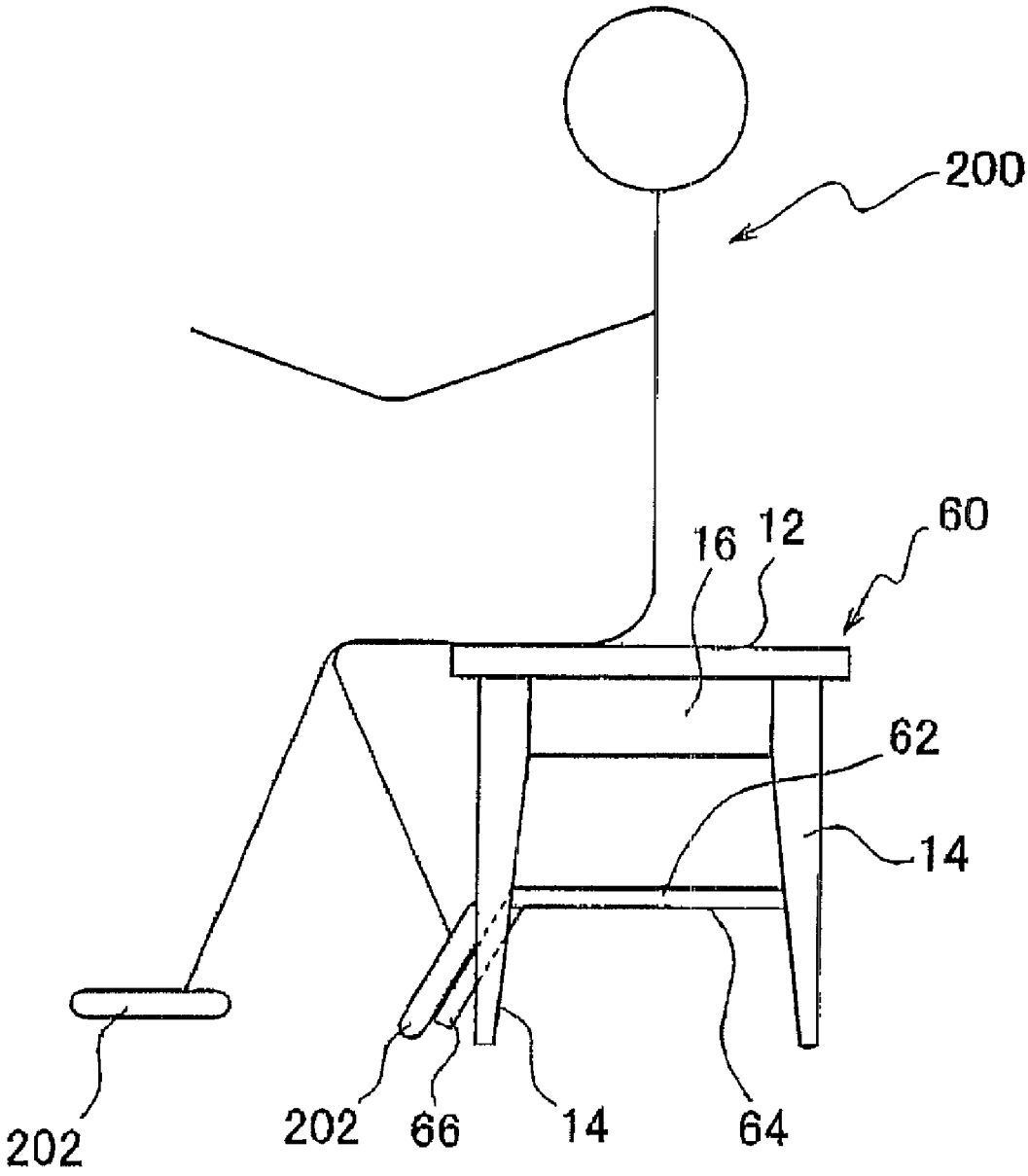
FIG. 6 is an explanatory view showing a state of use of the stool according to the fourth embodiment.

As shown in FIGS. 5A, 5B, and FIG. 6, a connecting board 62 of the stool 60 includes a flat portion 64 and an inclined portion 66. The flat abortion 64 is formed in a shape approximately similar to the shape of the connecting board 20 according to the first embodiment. However, in the player's legs side of the flat portion 64, a cutout 65 is formed so as to have a rectangular shape concaved toward an inner direction of the flat portion 64.

On the other hand, the inclined portion 66 is formed so as to project from a rear side of the cutout 65 toward foot 202 of a player 200, and to be inclined downward.

Figure 7:
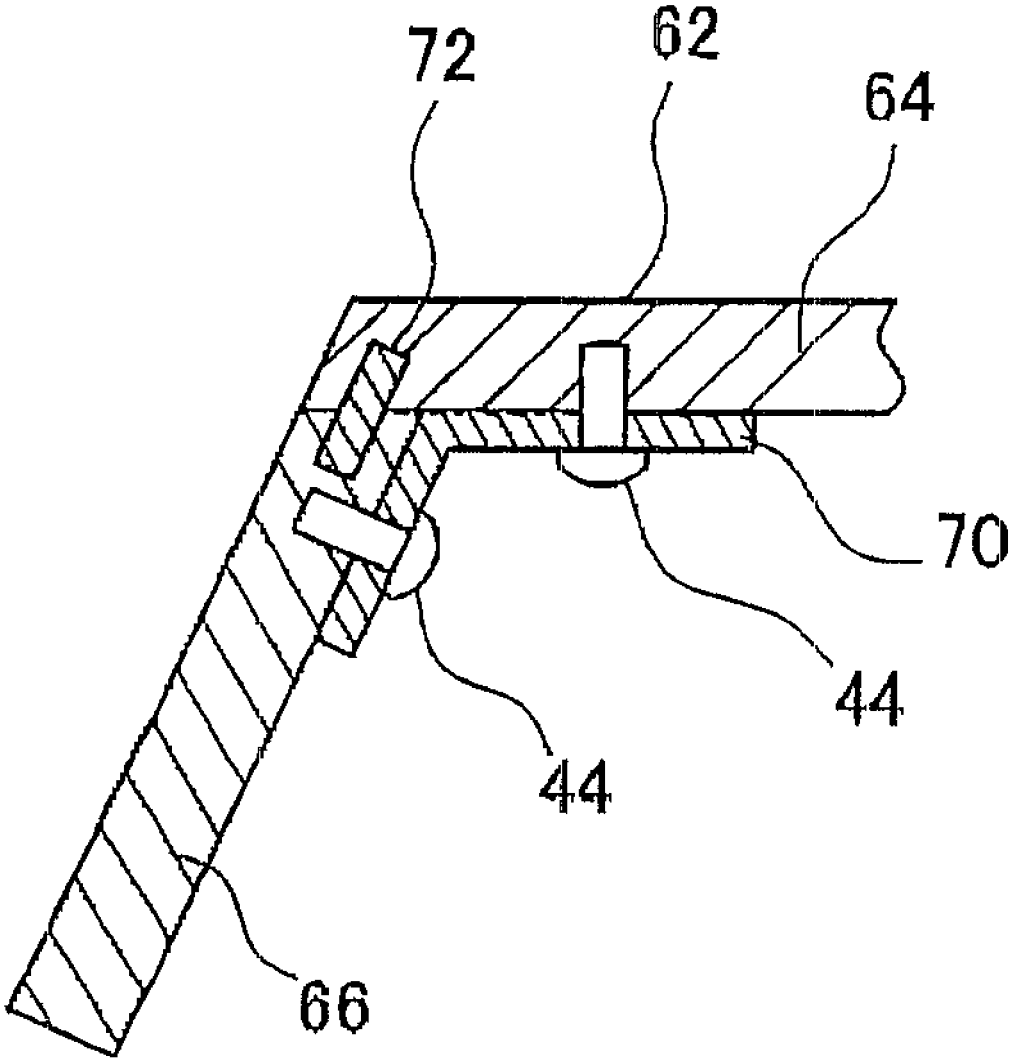
FIG. 7 is a sectional view showing a connection structure of a flat portion and an inclined portion of the connecting board according to the fourth embodiment.

The inclined portion 66 may be made of a single board material by bending a portion of the material corresponding to the inclined portion 66. Alternatively, as shown in FIG. 7, the flat portion 64 and the inclined portion 66 may be made of separate board materials. In FIG. 7, the flat portion 64 and the inclined portion 66 are connected to each other by a L-shaped bracket 70 bent so as to match an inclined angle of the inclined portion 66. More specifically, wooden screws 44 secure the L-shaped bracket 70 so as to connect the flat portion 64 and the inclined portion 66. In this configuration, the connection strength of the flat portion 64 and the inclined portion 66 may be improved by embedding a connecting member 72, made of a wooden or a metallic material into a bar-shape or a cylindrical shape, in each connecting portion of the flat member 64 and the inclined portion 66.

In the above-described stool 60 according to the fourth embodiment, the following advantages are achieved due to the connecting board 62. While the strength of the stool 60 is increased against a load applied in a direction intersecting the downward direction by the connecting board 62 connecting the four legs 14, a posture of a player 200 can be stabilized by the player 200 contacting his/her foot 202 with the inclined portion 66 provided to the connecting board 62.

Fifth Embodiment

A connecting board 80 according to the fifth embodiment is different from the connecting board 62 according to the fourth embodiment in a way that the inclined portion 66 is movably provided. The same referential numerals as in the fourth embodiment are given to the identical constituents, and the description thereof is omitted here.

Figure 8:
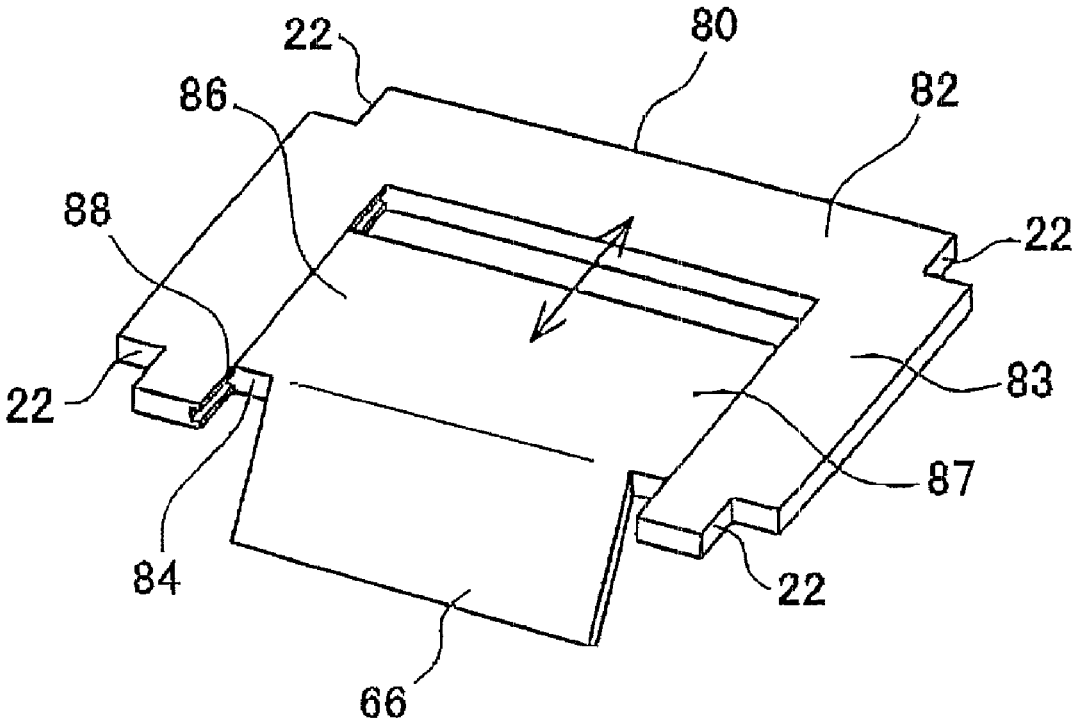
FIG. 8 is a perspective view showing a connecting board according to a fifth embodiment of the present invention.

As shown in FIG. 8, the connecting board 80 includes a fixed portion 82 and a movable portion 86.

The fixed portion 82 is a single board material formed into a U-shape, and provided with one pair of arm portions 83. On an inner surface of each of the arm portions 83, a groove 88 is formed so as to extend from an opening side of the U-shape toward a rear side thereof. The fixed portion 82 is secured to each of the legs 14 (see FIG. 2) by engaging members 32 (see FIG. 2).

On the other hand, the movable portion 86 includes a flat portion 87 and an inclined portion 66. As described in the fourth embodiment, the movable portion 86 may be formed with a single board material by bending a portion of the material corresponding to the inclined portion 66, or formed by connecting a separate flat portion 87 and an inclined portion 66 by the L-shaped bracket 70. On each lateral surface of the flat portion 87 facing the arm portions 83, a projected portion 84 is formed so as to be engaged with the groove 88 of the arm portion 88. By the projected portions 84 of the movable portion 86 being engaged with the grooves 88 of the arm portions 83, the fixed portion 82 supports the movable portion 86 so as to be movable in the front-to-rear direction shown by an arrow in FIG. 8.

The connecting board 80 may be provided with a mechanism that restricts the movement of the movable portion 86 when the movable portion 86 is in an extended position. For example, in the sliding direction of the movable portion 86, a plurality of concaved portions may be provided to one of the fixed portion 82 and the movable portion 86. The other portion may be provided with a spring member that goes in and out of the concaved portions. The movement of the movable portion 86 may be restricted by the spring member being engaged with one of the concaved portions.

In the above-described configuration of the connecting board 80 according to the fifth embodiment, the movable portion 86 can be slid within a range of the arm portions 83 of the fixed portion 82. Therefore, a player can move the inclined portion 66 toward the his/her legs and use the inclined portion 66 whenever necessary.

On the other hand, when a player does not use or does not need the inclined portion 66, the inclined portion 66 can be stored inside of the connecting board 80 so that the inclined portion 66 does not interrupt performance of the player.

Other Embodiments

The above-described stools according to the first to fifth embodiments are configured such that a player is seated directly on a seat board. However, a seat board of a stool according to the present invention may be provided with a cushion attached on a seat board.

Moreover, the above-described stools according to the first to fifth embodiments are provided with legs made of rectangular timbers. However, the legs may be made of a material having a sectional shape other than a rectangular shape (for example, a circular shape).

Furthermore, in the above-described second and third embodiments, the cutout formed on the connecting board is in a circular arc shape. However, the shape of the cutout may be formed in a shape other than the circular arc shape (for example, a rectangular shape), as long as the cutout is suitably shaped so as to inhibit legs of a player from contacting the connecting board.

Still furthermore, in the above-described fourth and fifth embodiments, the inclination angle of the inclined portion 66 is fixed. However, the connecting board 60 according to the fourth embodiment and the connecting board 80 according to the fifth embodiment may be configured such that the inclination angle of the inclined portion 66 is adjustable. Such configuration can be achieved, in a case wherein the flat portion 64 and the inclined portion 66 are made of separate members (see FIG. 7), for example, by using a shaft member capable of changing and fixing a rotational angle.

Still furthermore, in the above-described first to fifth embodiments, the securing position adjustment mechanism is configured so as to change the securing position of the connecting board by removably securing the connecting board to the legs of the stool. However, the configuration of the securing position adjustment mechanism is not limited to the above-described configuration. The securing position adjustment mechanism may be configured, for example, such that the securing position of the connecting board can be changed by sliding the connecting board in the up-and-down direction with respect to the legs of the stool.

Moreover, in the above-described first to fifth embodiments, the stools are provided with four legs. However, a stool according to the present invention may be provided with two, three, five or more legs.

Additionally, the legs of the stools according to the above-descried first to fifth embodiments are attached in vicinity of the peripherals of the seat boards. However, the legs may be attached in the inner side of the seat board.

Moreover, in the above-described first to fifth embodiments, each of the legs are provided with three embedded nuts 42. However, the number of the embedded nuts 42 provided to each of the legs may be two, four, or even more.

Furthermore, in the above-described first to fifth embodiments, the connecting board is horizontally attached. However, the connecting board may be attached in an inclined manner with respect to the horizontal direction.

Although specific embodiments have been illustrated and described herein, it is to be understood that the above description is intended to be illustrative, and not restrictive. Combinations of the above embodiments and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. A stool comprising:

a seat board;

a plurality of legs fixedly attached to the seat board so as to protrude from a bottom surface of the seat board in a downward direction, and to support the seat board such that the seat board is horizontally supported for supporting an individual in a seated position, and each of the plurality of legs having a pair of adjacent inwardly facing tapering surfaces which taper toward a bottom side of the stool;

a connecting board disposed such that one surface thereof faces a bottom surface of the seat board, the connecting board having a plurality of notches and being surrounded by and secured to the plurality of legs via the plurality of notches such that each one of the plurality of notches engages with the pair of adjacent inwardly facing tapering surfaces of a respective one of the plurality of legs; and an adjustment mechanism which enables changing a securing position of the connecting board, with respect to each of the plurality of legs and the seat board, by permitting movement of the connecting board, in an up and down direction, so that the connecting board is located parallel to the connecting board in a previously secured position once the connecting board is adjusted and secured to the plurality of legs;

wherein the connecting board comprises a fixed member and a slidable member;

the slidable member comprises an inclined portion which projects outwardly from a front periphery of the slidable member and is inclined downward; and the fixed member is configured to be secured to the plurality of legs and support the slidable member such that the slidable member, including the inclined portion, is movable relative to the fixed member.

2. The stool as set forth in claim 1, wherein the connecting board is secured to the plurality of legs so as to be horizontally supported.

3. The stool as set forth in claim 1, wherein the plurality of legs are respectively attached in a vicinity of a periphery of the seat board.

4. The stool as set forth in claim 1, wherein the connecting board is secured to a lower portion of each of the plurality of legs.

5. The stool as set forth in claim 1, wherein the adjustment mechanism is configured so as to removably secure the connecting board in one of a plurality of predetermined positions provided on each of the plurality of legs along the up-and-down direction.

6. The stool as set forth in claim 5, wherein the adjustment mechanism comprises:

a plurality of engaged members, each of the plurality of engaged members being provided in one of the plurality of predetermined positions; and an engagement mechanism that removably engages the connecting board with the plurality of engaged members.

7. The stool as set forth in claim 6, wherein the engagement mechanism comprises a plurality of engaging members, each of the plurality of engaging members being associated with one of the plurality of legs, and each of the plurality of engaging members comprises a connecting portion to be connected to the connecting board, and an engagement portion to be engaged with one of the plurality of engaged members.

8. The stool as set forth in claim 7, wherein the plurality of engaging members are configured such that the connecting portion is connected to a bottom surface of the connecting board, and the engagement portion is engaged with one of the plurality of engaged members.

9. The stool as set forth in claim 8, wherein the bottom surface of the connecting board is provided with a plurality of engagement openings so as to engage a plurality of screw members with the bottom surface of the connecting board, each of the plurality of engagement openings is associated with one of the plurality of engaging members, each of the plurality of engaging members is provided with a through hole formed in the connecting portion so as to insert one of the plurality of screw members into one of the plurality of engagement openings, and an opening of the through hole extends in a direction such that a position for inserting one of the plurality of screw members is displaced corresponding to a change in the securing position of the connecting board.

10. The stool as set forth in claim 8, wherein each of the plurality of engaging members is a plate member formed into a L-shape.

11. The stool as set forth in claim 7, wherein each of the plurality of engaged members is a nut, the engagement mechanism comprises a plurality of bolts, and each of the plurality of bolts being associated with one of the plurality of engaging members, and the engagement mechanism is configured such that each of the plurality of bolts is inserted into the engagement portion of one of the plurality of engaging members so as to be engaged with one of the plurality of engaging members.

12. The stool as set forth in claim 11, wherein the plurality of engaged members are embedded in the plurality of legs.

13. A stool comprising;

a seat board;

a plurality of legs attached to the seat board so as to protrude from the seat board in a downward direction, and to support the seat board such that the seat board is secured in a horizontal position; and a connecting board disposed vertically below the seat board such that one surface thereof faces a bottom surface of the seat board, the connecting board being surrounded by and secured to the plurality of legs so as to be prevented, in a horizontal position of the connecting board, from protruding outwardly from an inner area defined by the plurality of legs, further comprising an adjustment mechanism that enables a change of a securing position of the connecting board, with respect to each of the plurality of legs, in an up and down vertical direction, the adjustment mechanism being configured so as to removably secure the connecting board in one of a plurality of predetermined positions provided on each of the plurality of leas along the up-and-down vertical direction;

wherein the connecting board comprises a fixed member and a slidable member;

the slidable member comprises an inclined portion which projects outwardly from a front periphery of the slidable member and is inclined downward; and the fixed member is configured to be secured to the plurality of legs and support the slidable member such that the slidable member, including the inclined portion, is movable relative to the fixed member.

14. The stool as set forth in claim 9, wherein the plurality of engaged members are provided on at least one of the pair of adjacent inwardly facing tapering surfaces of the plurality of legs.

* * * * *